United States Patent [19]

Greer

[11] 4,103,574

[45] Aug. 1, 1978

[54] TOOL ASSEMBLY, METHOD OF MANUFACTURE AND COMPONENTS THEREOF

[76] Inventor: H. William Greer, 18 Patti Ct., Franklin, Ohio 45005

[21] Appl. No.: 493,757

[22] Filed: Aug. 1, 1974

[51] Int. Cl.[2] ..... B26F 1/14

[52] U.S. Cl. ..... 83/140; 83/685; 83/698; 85/9 R; 85/45; 279/24

[58] Field of Search ..... 83/698, 685, 686, 140; 279/24, 29, 30; 85/45, 9 R

[56] References Cited

U.S. PATENT DOCUMENTS

| | | | |
|---|---|---|---|
| 2,364,401 | 12/1944 | Stellin | 83/698 X |
| 3,086,072 | 4/1963 | Forman | 85/45 X |
| 3,424,212 | 1/1969 | Kemper | 85/45 X |

FOREIGN PATENT DOCUMENTS

| | | | |
|---|---|---|---|
| 750,894 | 6/1956 | United Kingdom | 85/9 R |

*Primary Examiner*—J. M. Meister

*Attorney, Agent, or Firm*—Biebel, French & Nauman

[57] ABSTRACT

A tool assembly in which the tool retainers are provided with spring loaded plungers which snap into place in detents provided in the tools and are then locked in the detents by set screws engaging the shanks of the plungers. This prevents inadvertent displacement of the tools, particularly punches, from their retainers, especially displacement due to jarring or vibration during manufacturing of the tool assembly. The retainers are attached to their respective shoes by bolts having tool engageable sockets in both their leading ends and their heads. This facilitates manufacture of the tool assemblies while permitting replacement of the tool retainers without removing the shoes from the press in which they are mounted. Additionally, a stripper plate may be mounted by means of bolts having tool engageable sockets in either end to permit the plate to be removed from the press without removing the shoe to which the stripper plate is attached.

19 Claims, 17 Drawing Figures

TOOL ASSEMBLY, METHOD OF MANUFACTURE AND COMPONENTS THEREOF

BACKGROUND OF THE INVENTION

In conventional tool assemblies, a punch shoe may be mounted on the ram of a press and carry one or more punch retainers attached thereto by means of dowels and bolts and carrying one or more punches. Attached to the bed of the press is a die shoe which may have mounted therein a die retainer attached thereto by dowels and bolts and carrying a die button complementary to the punch. Additionally, a stripper plate may be associated with the assembly to strip the stock from the punch as it is withdrawn from the die.

In a typical manufacturing operation for producing a tool assembly as described above, the die sets are first mounted on the die shoe at the desired locations. The punch shoe is then positioned on a suitable supporting surface and the die shoe is positioned over the punch shoe. The punch and die shoes may be provided with interengaging bushings and guide pins for alignment purposes, with the punch shoe having bushing lined openings therethrough and the die shoe having pins mounted at the corners thereof which are slidably received in the bushings in the die shoe.

The necessary number of punch retainers are then positioned on the punch shoe in their approximate positions opposite their respective dies. Each of the punch retainers will include one or more punches projecting therefrom. The punches may be secured in the retainers by means of bolts or the like threaded through the sides of the retainers and engaging detents in the punches to lock the punches in position.

Securing the punches in their retainers in this manner requires moving the punches manually in their sockets while manipulating the bolts until the end of the bolt can be felt entering the detent, then locking the bolt in position. A more convenient manner of assembling the punches in their retainers, and probably a more commonly used method, is to provide the retainers with spring loaded balls which ride in passageways angularly disposed upwardly and outwardly with respect to the punch sockets.

The upward and outward inclination of the passages carrying the spring loaded balls allows the punches to be inserted into the sockets relatively easily but resists forces tending to remove the punches from the sockets, as would be encountered as the punch is withdrawn from stock which it has pierced.

However, after the punch retainers carrying the punches are positioned approximately on the punch shoe, as noted above, it is necessary to bring the die shoe carrying the dies down into close proximity to the punch shoe in order to align the punches with the die openings.

During this operation there is a tendency for the guide pins to bind in the bushings, particularly with very large assemblies in which the shoes may be several feet in length and width. To overcome binding it is common practice to pound or vibrate the shoes. However, this may cause the punch retainers, which are merely resting on the surface of the punch shoe, to jump from the surface of the shoe.

Since the spring loaded balls are intended primarily to resist forces tending to withdraw the punch from the punch socket, when the punch retainers separate from the surface of the punch shoe, the punches may slip further through their sockets and project out the opposite surfaces of the retainers. This results in the punch being cocked with respect to the die with which it is to be aligned and requires removal of the punch and retainer so that the punch may be positioned properly within the punch socket, and this in turn may also necessitate separation of the punch shoes in order to reach the retainer.

Thus, although retainers utilizing spring loaded balls provide advantages over those utilizing bolts to fix the punches in place, their use presents problems during the manufacture of tool assemblies which complicate the manufacturing process and increase its cost.

In further steps in a conventional manufacturing operation, after the retainers carrying the punches have been positioned on the surface of the punch shoe and the die shoe brought into proximity with the underlying punch shoe, it is common practice to align the punches with their opposing dies by visually sighting the punches through the scrap openings in the die shoe and the die openings.

Thereafter, the outline of the retainer is scribed on the surface of the punch shoe and the die shoe is removed from its position overlying the punch shoe. Tool retainers such as the punch retainers are generally purchased by the manufacturer of the punch and die assembly and are provided with precisely located predrilled dowel holes, for a purpose to be described presently, and slightly oversized, predrilled bolt holes.

After the die shoe has been removed from its overlying relationship to the punch shoe, the predrilled retainers are positioned within the scribed lines and, using the predrilled bolt holes as a guide, the location of bolt holes in the punch shoe are marked using a transfer punch. The retainers are then removed and bolt holes drilled and tapped into the punch shoe.

The retainers are then attached to the punch shoe by means of bolts extending through the predrilled bolt holes in the retainers and the bolt holes which have been drilled and tapped in the punch shoe. The bolt holes through the retainers are of somewhat larger diameter than the shanks of the bolts and are counter bored to receive the bolt heads therein.

Therefore, until the bolts are tightened, a limited amount of movement of the retainers on the punch shoes is permitted. The retainers therefore, are attached to the punch shoe without the retainer bolts being tightened and the die shoe is once again brought into position over the punch shoe and, again, sighting through the openings in the die shoe and die, the punches are aligned precisely with the die openings.

Where very precise alignment is required, the punch may have a diameter such that it is received in the die opening without the customary clearance between the inner surface of the die and the outer surface of the punch and the oversize punch is then moved into the die opening to align the punches and dies. Following this, of course, the punch would then be ground down to provide the necessary clearance after it had served its alignment function.

In any case, after the punch has been aligned with the die the retainer bolts are tightened to fix the position of the retainer on the punch shoe. The die shoe is again removed and, using the predrilled dowel holes in the retainer as a guide, matching dowel holes are drilled in the punch shoe.

Usually following this operation, the retainers are unbolted from the punch shoe, a predrilled backing plate of hardened steel interposed between the surface of the punch retainer and the shoe, and the retainer secured to the punch shoe by means of the retainer bolts and press fitted dowels received in the aligned dowel openings.

As noted above, the dowel openings in the retainers are precisely drilled by the retainer manufacturers and, therefore, when, during use of the tool assembly it is necessary to replace the retainers, the new retainers are positioned precisely with their punches in exact alignment with the dies without the necessity of realigning the punches and dies.

The bolts utilized to bolt the retainers to the punch shoes after alignment of the punches and dies are provided with a tool engageable socket in their heads so that they may be tightened by, for example, an Allen type wrench. However, it is often the case that when the die shoe is brought into proximity to the punch shoe so that the punches can be aligned with the dies, there is insufficient clearance between the two shoes to insert a wrench to tighten the retainer bolts.

Therefore, after the punches and dies have been aligned, the die shoe must be raised to allow the retainer bolts to be tightened. Very often this disturbs the alignment of the punches and dies, so that after the retainer bolts are tightened and the die shoe brought down into proximity with the punch shoe to check the alignment, the punches and dies are found to be misaligned.

This necessitates raising the die shoe, loosening the retainer bolts, lowering the die shoe, realigning the punches and dies, raising the die shoe, tightening the retainer bolts, lowering the die shoe to again check the alignment, and, if the punches are again misaligned, repeating the entire process as often as necessary to obtain the alignment of the punches and dies.

While in the above description the dies are described as fixed to the die shoe and the punches aligned with the fixed dies, and also that the die shoe is positioned over the punch shoe during the alignment operations, it will be apparent that in variations of this procedure one or both of these may be reversed.

It has been suggested that a tapped, press fitted nut be inserted in the counter bored holes in the punch retainer and that a drilled and counter bored hole rather than a tapped hole be formed in the punch shoe with the counter bore being at the surface of the shoe opposite the surface thereof adjacent the retainer. However with this construction when the punch shoe is mounted in a press, whenever it is necessary to replace a retainer, the entire shoe must be removed from the press so that access can be had to the bolt head.

It will be apparent, therefore, that in conventional tool assembly manufacturing, the use of conventional tool components often results in excessive amounts of lost time by highly skilled tool makers and, consequently, a substantial increase in manufacturing costs.

SUMMARY OF THE INVENTION

The present invention provides an improved tool assembly, a method of manufacturing the assembly and components thereof which obviate many of the repetitive operations necessary when utilizing conventional manufacturing methods and tool components.

Specifically, the tool retainer, whether it is the punch or die retainer or both, incorporates a spring loaded plunger which is slidably received in a passage extending from an outside surface of the retainer into the tool receiving socket. Preferably the passage extends substantially normal to the axis of the tool socket and the plunger carries a head which projects into the socket and is received in a detent in the tool.

Extending from the head of the plunger away from the socket is a shank which is encircled by a coil spring which bears at its inner end against a collar on the plunger adjacent the head thereof. In one embodiment of the invention the opposite end of the spring bears against bolt, set screw, or other threaded member received in the passage. With this construction the tool can be inserted in the socket until the head of the plunger snaps into place in the detent. Thereafter, the set screw is tightened into engagement with the end of the plunger shank, locking the head of the plunger in the tool detent and the tool in its retainer.

As a result, despite pounding and jarring of the shoe on which the retainer is positioned before it is attached thereto, the tool cannot slip completely through its socket as in the case of conventional, spring loaded ball type retainers.

As the same time, excessive manipulation of the tool in the socket and a bolt to lock the tool in the socket is avoided and the tool is also fixed in the retainer against forces tending to withdraw it during operation of the tool assembly.

In a secoond embodiment of the invention, a spring loaded plunger encircled by a coil spring bearing at one end against a collar of the plunger is also utilized. However, the opposite end of the coil spring has a terminal portion projecting at approximately right angles to the axis of the spring and received in a drilled opening intersecting the plunger-receiving passage.

A bolt, set screw or other threaded member is also used to lock the plunger in place once the head thereof has snapped into the detent in the tool. Rather than being threaded into the plunger-receiving passage itself, however, the threaded member intersects the passage at right angles and a chamfered end surface thereof bears against a chamfered end of the plunger.

This permits the plunger to be locked in place even through access to the side of the retainer is not possible, as would be the case, for example, where two or more retainers are positioned side by side or in very close proximity to each other.

While for purposes of illustration a retainer is disclosed below having a single tool receiving socket, it will be apparent that retainers in accordance with the present invention may incorporate two or more sockets, each provided with a spring loaded plunger and a locking set screw, bolt or the like.

In accordance with a further feature of the present invention, retainer bolts are provided which include a tool engageable socket in both their leading ends as well as in their heads.

With this construction, after the retainers have been attached to their shoe, the opposing shoe brought into proximity thereto and the punches and dies aligned precisely, it is immaterial whether sufficient clearance exists between the opposing shoes to allow a wrench to be inserted in the sockets of the heads of the retainer bolts, since the wrench can be simply inserted through the tapped bolt holes in the shoe from the opposite side thereof and into the sockets in the leading ends of the bolts.

The retainers can thus be fixed in position while their alignment is being checked, and the repetitive operations described above of separating the shoes, tightening the bolts, repositioning the shoes and checking the alignment, and then, if necessary, separating the shoes, loosening the bolts, bringing the shoes back into position again and repeating the operation is avoided.

While as noted above, it has been suggested that a press fitted nut be inserted in the counter bored, predrilled holes in the retainer and counter bored holes drilled through the shoes so that the bolt heads are accessible from the undersurface of the shoes during the alignment and tightening processes, with this type of construction, once the tool assembly is mounted in a press and it becomes necessary to replace the retainer, the entire shoe must be removed from the press.

In contrast, with a tool assembly of the present invention the bolt heads and the sockets therein are positioned when the tools are mounted in the press such that they are accessible and the retainers replaceable as in a conventional tool assembly.

A stripper plate may also be mounted on the punch shoe by means of stripper bolts having tool engagable sockets in not only the heads thereof but in their leading ends as well. Therefore, when it becomes necessary to remove the stripper plate, it is no longer necessary to remove the punch shoe from the press since the stripper bolts may now be rotated from their accessible leading ends.

It will be seen, therefore, that the tool assembly, method of manufacturing it and components thereof in accordance with the present invention provide marked advantages over conventional assemblies, manufacturing processes and components with relatively little if any increase in component costs and marked savings in manufacturing costs, tool operation and performance.

DESCRIPTION OF THE PREFERRED EMBODIMENTS

Figure 1:
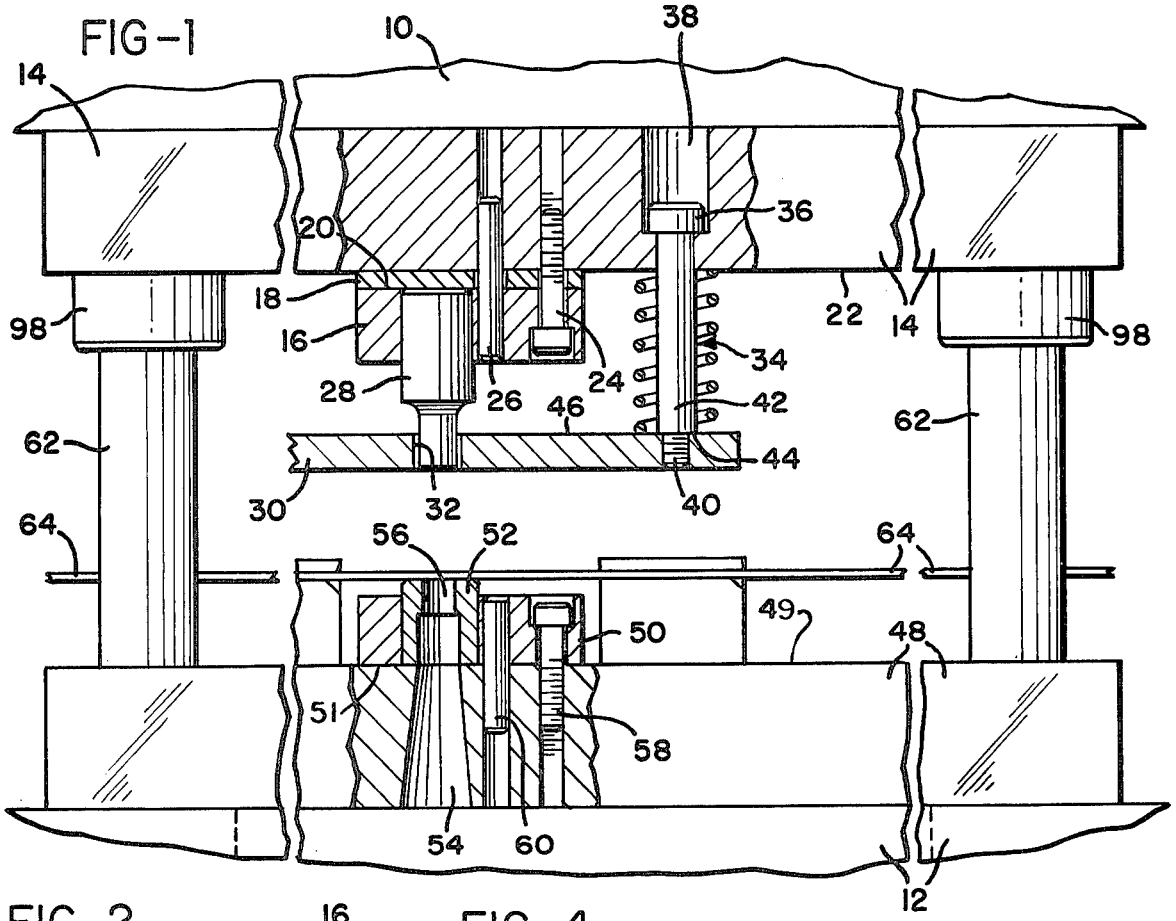
FIG. 1 is an elevational view, partly in section, with the tool retainers viewed approximately along line 1—1 of FIG. 2, and showing the tool assembly mounted in a press.
Figure 2:
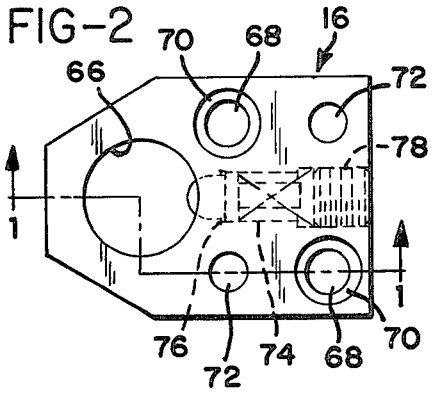
FIG. 2 is a plan view of an improved tool retainer in accordance with the present invention.

The assembly shown in FIG. 1 of the drawings includes a press ram 10 positioned above a press bed 12 and carrying a punch shoe 14. A retainer 16 having a backing plate 18 interposed between its inner face 20 and the inner face 22 of the shoe 14 is attached to the shoe by means of bolts 24 and dowel pins 26. A punch 28 is carried in the retainer 16 and a stripper plate 30 may be provided having an opening 32 through which the leading end of the punch may project.

The stripper plate 30 is attached to the shoe 14 by means of stripper bolts, one of which is shown at 34. The stripper bolts are provided with enlarged heads 36 received in counterboard sockets 38 in the shoe 14 and are threaded, as at 40, into a tapped hole in the plate 30. Preferably the shank 42 of the stripper bolt is of substantially greater diameter than the threaded portion 40 thereof to provide a shoulder 44 bearing against the upper surface 46 of the stripper plate 30, and a coil spring 47 is positioned about the shank 42 of the stripper bolt.

A die shoe 48 having an inner face 49 is attached to the press bed 12 by any conventional means such as clamps or the like and carries a die retainer 50 having an inner face 51, the die retainer carrying a die button 52. A scrap opening 54 extends through the die shoe 48 in alignment with the die opening 56 and, similarly to the retainer 16, the retainer 50 may be secured to the shoe 48 by means of retainer bolts 58 and dowel pins 60. Additionally, guide pins 62 may be provided to maintain the shoes in alignment during operation of the tool assembly.

With this configuration, it will be apparent that when a workpiece 64, such as a sheet of metal, is positioned between the punch and die, and the ram 10 descends, causing the punch to pierce the workpiece 64, the coil spring 47 will compress to allow the stripper plate to ride up on the leading end of the punch. As the ram 10 ascends, the punch it withdrawn from the die and the stripper plate is pushed downwardly by the spring 47 to strip the workpiece from the leading end of the punch.

In accordance with one embodiment of the present invention the punches and dies may be secured in their respective retainers by means of the spring loaded plunger and set screw or bolt combination best seen in FIGS. 2 through 7 of the drawings. While both the punch and die retainers may be substantially identical, for purposes of illustration the punch retainer 16 will be described first.

Thus, the retainer 16 includes a punch socket 66 and a pair of bolt holes 68, each of which has counter bored portions 70. Additionally, the retainer will be provided with smooth bored dowel holes 72 and a passageway 74 having a shouldered portion 76 and a threaded portion 78. A plunger 80 is slidably received in the passage 74 and is provided with a head 82, a collar 84, and a shank 86.

A bolt, set screw or the like 88 is threaded in the portion 78 of the passage in spaced relationship to an outer end 90 of the plunger and a coil spring 92 encircles the shank 86 and bears at its inner end against the collar 84 and at its outer end against the threaded member 88.

Figure 4:
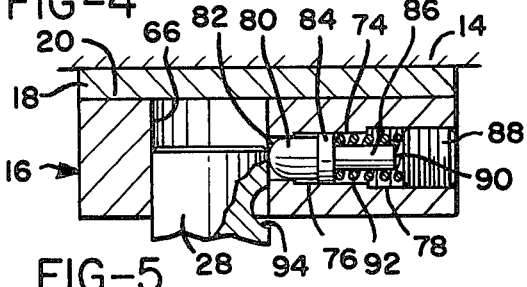
FIG. 4 is a cross sectional view through the tool retainer showing a tool partially inserted in the socket thereof.
Figure 5:
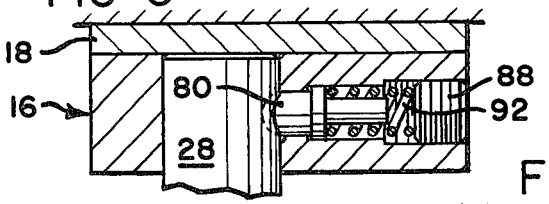
FIG. 5 is a view similar to FIG. 4 but showing the tool fully received in the socket and the plunger head received in the tool detent.
Figure 3:
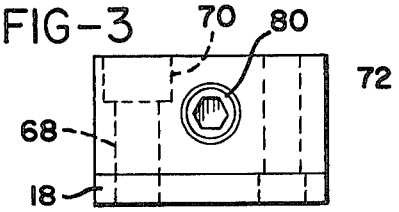
FIG. 3 is an elevational view of the retainer of FIG. 2.
Figure 6:
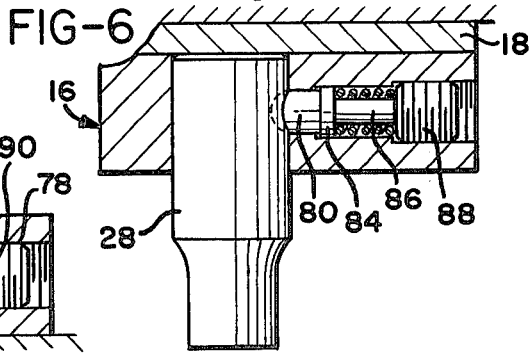
FIG. 6 is a further view similar to FIG. 4, but showing the plunger locked into position in the tool detent.
Figure 9:
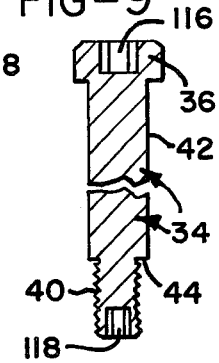
FIG. 9 is a cross sectional view through an improved stripper bolt.

With this construction it will be seen that as the punch 28 is inserted in the socket 66 the plunger moves to the right as seen in FIG. 4 of the drawings, compressing the spring 92 and allowing the punch to be inserted into the socket. If the detent 94 in the punch is not aligned with the head 82 of the plunger the punch may be rotated slightly until the head of the plunger snaps into position in the detent, as seen in FIG. 5 of the drawings. After this the threaded member 88 is tightened until its leading end engages the end 90 of the shank of the plunger, locking the plunger in the punch and the punch in the retainer.

Figure 7:
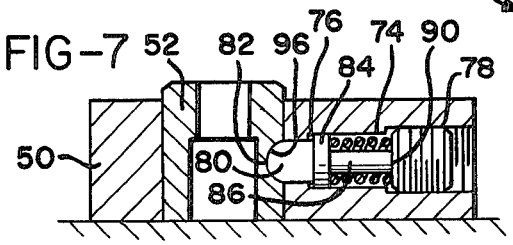
FIG. 7 is a view similar to FIG. 4, but showing the retainer of the present invention carrying a die button.

While the construction of the die may vary, it is possible to utilize a retainer in accordance with the present invention for mounting a die button in a manner similar to that in which the punch is mounted in the punch retainer. Thus, as seen in FIG. 7 of the drawings, the retainer 50, similar to the retainer 16, is provided with a passageway 74 having a shouldered portion 76 and a threaded portion 78 and carries a plunger 80 having a head 82, a collar 84 and a shank 86 terminating in an outer end 90 which is engaged by a set screw, bolt, or the like 88 to lock the head 82 in a detent 96 in the die button 52.

While in the above description single punch and die retainers each carrying a single punch and die are shown, it will be apparent that in accordance with the present invention each shoe will usually carry several retainers and that each retainer may carry more than a single tool.

Figure 10:
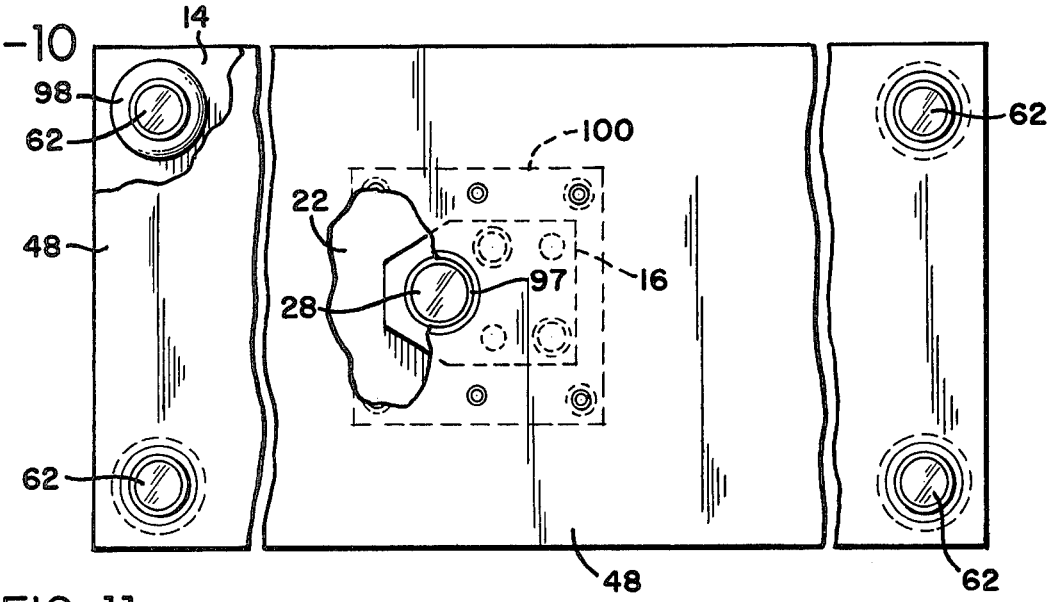
FIG. 10 is a view of a pair of superimposed tool shoes with portions broken away and illustrating a step in the manufacturing process.

Turning now to FIG. 10 of the drawings, the manufacture of a tool assembly in accordance with the present invention will be described. Initially, the dies are attached to the die shoe 48 and the punch and die shoes positioned with respect to each other in the position reverse to that shown in FIG. 1 with the die shoe 48 overlying the punch shoe 14.

Guide pins 62 on the punch shoe 48 are slidably received in bushing 98 in the corners of the shoe 14 and one or more retainers 16, one being shown for purposes of illustration, are positioned on the surface 22 of the punch shoe. For purposes of simplification the die is shown as a conventional die set 100 rather than a die retainer and button 50, 52, although it will be apparent that the die set 50, 52 could be used with equal facility.

Additionally, although the dies are described as attached first and the die shoes positioned over the punch shoe, it will be apparent that either of these steps may be reversed in accordance with the present invention.

Figure 11:
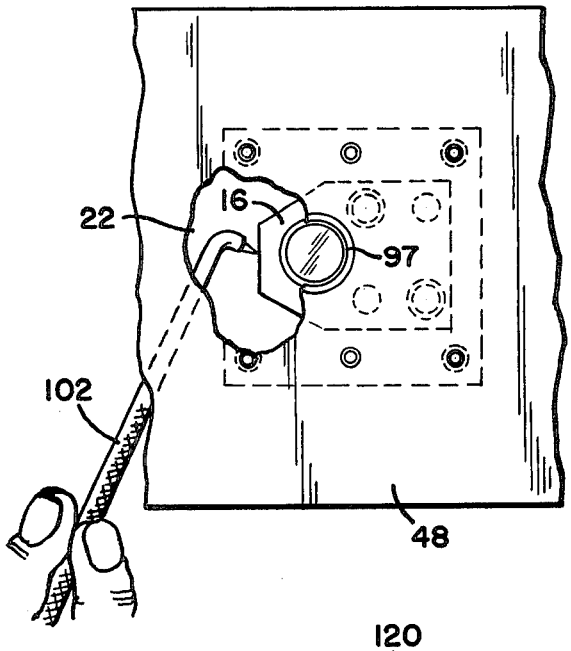
FIG. 11 illustrates a further step in the manufacturing process.

In any case, with the die or dies attached to the die shoe 48 and the retainers 16 carrying punches 28 positioned on the surface of the punch shoe, the die shoe is brought down into proximity with the punch shoe and the retainer 16 moved manually while the end of the punch is aligned visually through the die opening 97. Once the punch has been positioned in this manner, a scribe 102 may be used, as seen in FIG. 11 of the drawings, to scribe the outline of the retainer on the surface 22 of the punch shoe 14.

Figure 12:
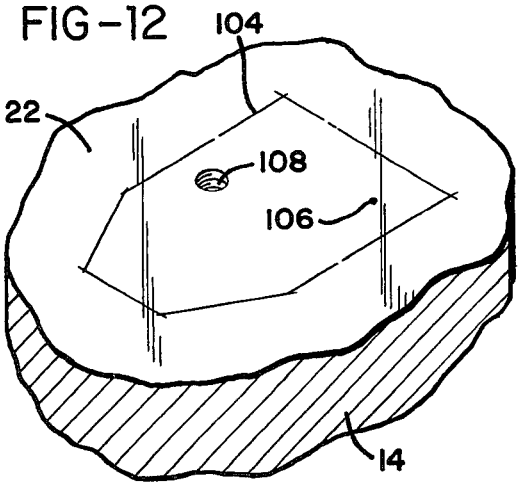
FIG. 12 is an enlarged view of a portion of a shoe showing the retainer outline scribed on the surface thereof and one tapped hole.
Figure 13:
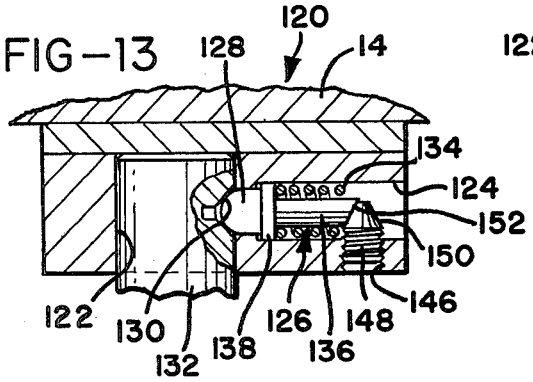
FIG. 13 is a cross sectional view, similar to FIG. 6, showing a second embodiment of tool retainer.

The punch and die shoes are then separated, the retainers aligned with their scribed outlines 104 (FIG. 12), and using the predrilled bolt holes in the retainer as a guide, the location of the bolt holes on the surface of the punch shoe are marked by a transfer punch. At each of the marks 106 thus indented into the surfaces 22, a bolt hole 108 is thereafter drilled and tapped. Following this the retainer 16 is attached to the shoe 14 by means of bolts 24, as seen in FIG. 13 of the drawings.

There is sufficient clearance between the bolts 24 and the bolt holes in the retainer to allow some relative movement between the retainer and its shoe until the retainer bolts are tightened. Therefore, following attachment of the retainers 16 to the shoe 14, but before the bolts 24 are tightened, the punch and die shoes are again brought together to the positions shown in FIG. 13 of the drawings and the punches and dies aligned precisely by sighting downwardly through the openings in the die shoe and die.

It will be noted that at this time insufficient clearance exists between the punch and die shoes to allow a wrench to be inserted in the socket 110 of the bolt. In a conventional manufacturing operation utilizing conventional components, this would necessitate the several steps described above to align the punch and die and tighten the retainer in place in the aligned position.

Figure 8:
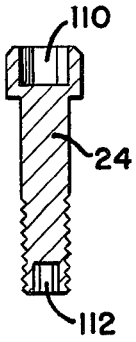
FIG. 8 is a cross sectional view through an improved retainer bolt.

However, in accordance with the present invention and as best seen in FIG. 8 of the drawings, the bolt 24 is provided with a second tool engageable socket 112 in the leading end thereof which permits the tool maker to simply insert an Allen wrench or the like through the bolt hole 108 in the shoe 114 and into the socket 112 to tighten the bolts 24 and fix the retainer 16 while the alignment of the punch 28 is maintained with the die opening in the die set 100.

Figure 14:
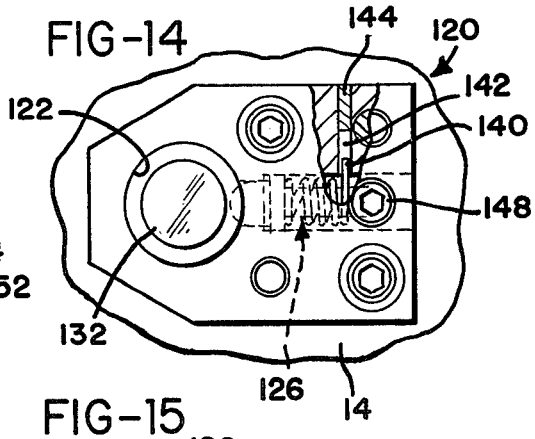
FIG. 14 is a plan view with portions broken away of the retainer of FIG. 13.

The shoes may then be separated, the precision drilled dowel openings 72 in the retainer 16 used as a guide for drilling corresponding dowel openings 114 in the shoe 14, the bolts 24 and the retainer 16 removed, a hardened, predrilled backing plate 18 interposed between the retainer 16 and the shoe 14, dowel 26 press fitted into place and the bolts 24 threaded into position as shown in FIG. 14 of the drawings. The tool assembly is then ready for mounting in a press as shown in FIG. 1.

In this regard, it will be noted that the stripper bolts, similarly to the bolts 24 are provided, not only with sockets 116 in the heads 36 thereof, but also with sockets 118 in the leading ends 40 thereof. Thus, when it becomes necessary to remove the stripper plate 30, the stripper bolts can be rotated in their counter bored openings 38 by inserting a wrench in the socket 118 rather than necessitating the removal of the entire punch shoe 14 from the press to obtain access to the socket 116.

The plunger of the tool retainer described in conjunction with FIGS. 2 through 7 of the drawings is locked into place by a set screw, bolt or the like threaded into a threaded end of the plunger-receiving passage and bearing axially against an end of the shank of the plunger. This requires access to a side of the retainer to tighten the threaded member into place.

It is quite possible, however, that two or more retainers may be positioned side by side or in such close proximity to each other that access to the end of the threaded member is not possible without removing adjacent retainers. To obviate this, the retainer shown in FIGS. 13 through 15 of the drawings may be used.

The retainer 120 is provided with a tool socket 122 and a passage 124 intersecting the socket at right angles thereof. A plunger 126 is slidably received in the passage and the head 128 thereof projects into a detent 130 in a tool 132. It will be noted from FIG. 13 that the detent 130 may be simply a center drilled hole rather than the finished detent shown in FIG. 4 of the drawings to effect a savings in manufacturing costs.

A coil spring 134 encircles a shank 136 of the plunger and bears at one end against a collar 138 adjacent the head of the plunger. The opposite end 140 of the spring is bent outwardly and is received in a small drilled hole 142, which may be plugged as shown at 144.

Figure 15:
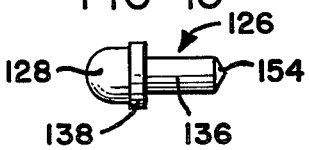
FIG. 15 is a view of modified plunger.
Figure 16:
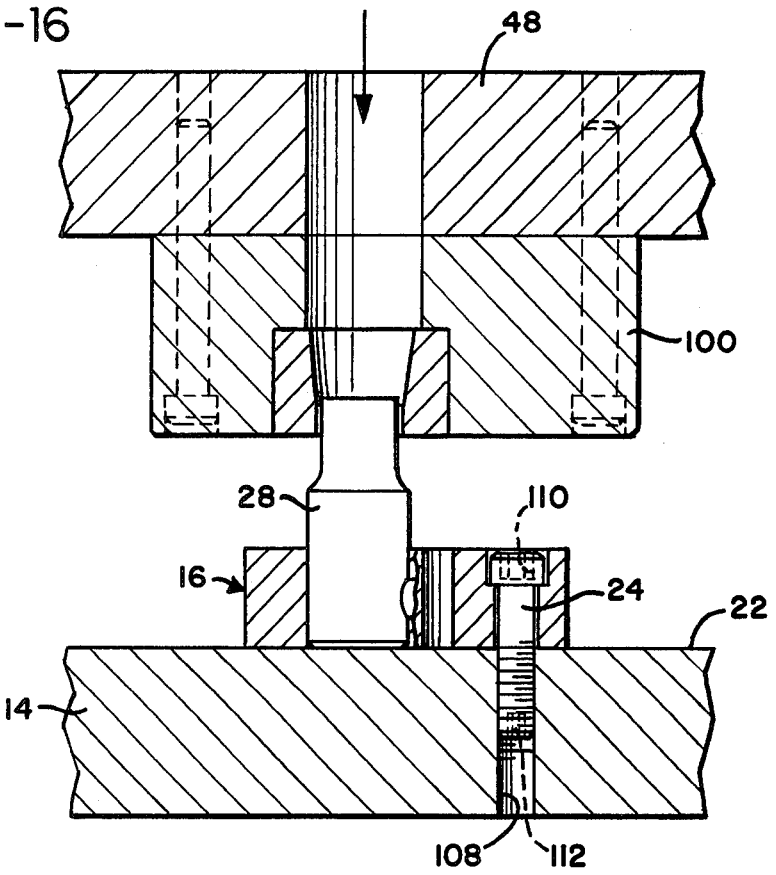
FIG. 16 illustrates a step in aligning and fastening a tool retainer to its shoe.
Figure 17:
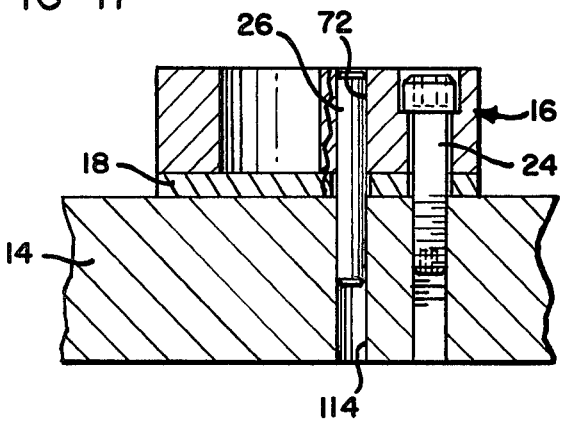
FIG. 17 is a cross sectional view illustrating a retainer bolted and pinned in place with a backing plate interposed between the surface of the retainer and shoe.

A threaded opening 146 intersects passage 124 perpendicularly thereof and receives a threaded member 148 having a bevelled leading end 150. End 150 of member 148 engages a bevelled end 152 of the shank 136, so that the head of the plunger may be locked in place upon tightening of the member 148. Alternately, as seen in FIG. 15, the end of shank may be shaped similarly to the end 150, as shown at 154.

In either case, after the head of the plunger has snapped into place even though there is insufficient space available to gain access to the side of the retainer and insert a tool into the head end of the threaded member.

From the above it will be seen that the present invention provides an improved tool assembly, method of manufacturing and components thereof which offer marked improvements over conventional manufacturing methods, assemblies and components.

While the method, apparatus and articles herein described constitute preferred embodiments of the invention, it is to be understood that the invention is not limited to these precise method, apparatus and articles disclosed therein and that changes may be made therein without departing from the scope of the invention.

What is claimed is:

1. An improved tool assembly comprising:
(a) a tool retainer having opposite, substantially planar faces,
(b) means defining a tool receiving socket in said retainer extending from one face thereof to the other,
(c) means defining a passage in said retainer disposed wholly intermediate said planar faces and extending from an outer surface thereof into said socket,
(d) a plunger having a tool engaging head slidably received in said passage with at least a portion of said tool engaging head projecting out of said passage and into said socket,
(e) means urging said plunger head outwardly of said passage and into said socket for engagement with a tool received therein, and
(f) means accessible from said outer surface of said retainer for locking said plunger in said passage against movement of said plunger head out of said socket.

2. The assembly of claim 1 further comprising:
(a) a shank portion of said plunger extending away from said head portion thereof.

3. The assembly of claim 2 wherein:
(a) said urging means comprises a spring encircling said shank portion of said plunger.

4. The assembly of claim 3 wherein:
(a) said plunger further includes a collar adjacent said head engaged by said spring.

5. The assembly of claim 3 wherein:
(a) said locking means engages said shank portion to lock said plunger in position.

6. The assembly of claim 5 wherein:
(a) said locking means comprises a threaded member threadably received in said passage.

7. The assembly of claim 5 wherein:
(a) said locking means comprises a locking member received in an opening intersecting said passage.

8. The assembly of claim 7 wherein:
(a) said locking member and said opening receiving said locking member are provided with complementary threads.

9. The assembly of claim 7 wherein:
(a) said locking member has a bevelled leading end, and
(b) said shank portion has a bevelled end engaged by said leading end of said locking member when said plunger is locked in place.

10. The assembly of claim 1 further comprising:
(a) a backing shoe,
(b) aligned bolt holes in said backing shoe and said retainer,
(c) bolts having heads and leading ends received in said aligned bolt holes and securing said retainer to said shoe, and
(d) means defining tool engageable sockets in both said heads and said leading ends of said bolts.

11. The assembly of claim 10 wherein:
(a) said bolt holes in said retainer are counter bored and receive said bolt heads.

12. The assembly of claim 11 wherein:
(a) said bolt holes in said shank are tapped and receive threaded portions of said bolts.

13. The assembly of claim 12 wherein:
(a) said bolt holes in said retainer and shank extend completely therethrough.

14. An improved tool assembly comprising:
(a) a tool retainer having inner and outer faces,
(b) a tool receiving socket in said retainer,
(c) means for fixing a tool in said socket,
(d) a plurality of bolt holes in said retainer,
(e) a backing shoe having inner and outer faces,
(f) a plurality of bolt holes in said shoe in alignment with said bolt holes in said retainer,
(g) a plurality of bolts each having a head and a leading end received in said bolt holes in said retainer and said shoe and securing said retainer to said shoe with said inner face of said shoe adjacent said inner face of said retainer,
(h) means defining tool engageable sockets in the heads of said bolts, and
(i) means defining tool engageable sockets in the leading ends of said bolts,
(j) whereby said bolts can be manipulated from said outer face of said shoe during initial assembly of said shoe and retainer and said bolts can be manipulated from said outer face of said retainer after said assembly thereof to facilitate retainer removal and replacement.

15. The assembly of claim 14 wherein:
(a) some of said bolt holes are formed with counter bored portions receiving said bolt heads.

16. The assembly of claim 15 wherein:
(a) said bolt holes extend through said retainer and said shoe.

17. The assembly of claim 16 wherein:
(a) said bolt holes in said retainer are counter bored.

18. The assembly of claim 17 wherein:
(a) said bolt holes in said shoe are internally threaded with threads complementary to and in engagement with external threads on said bolts.

19. An improved tool assembly comprising:
(a) a ram and a press bed disposed in opposition to each other, (b) punch and die shoes attached to said ram and press bed, respectively, (c) a punch retainer attached to said punch shoe with a backing plate interposed between opposing surfaces of said punch shoe and retainer and a die retainer attached to said die shoe, (d) a plurality of bolt holes extending through said punch retainer, backing plate and punch shoe in substantial alignment with each other and a plurality of bolt holes extending through said die retainer and die shoe in substantial alignment with each other, (e) said bolt holes in said shoes having internally threaded portions and said bolt holes in said retainer having counter bored portions in surfaces of said retainers facing each other, (f) a plurality of bolts having heads, shanks and leading ends with some of said bolts extending through said punch retainer and backing plate and into said punch shoe and others of said bolts extending through said die retainer and into said die shoe with threaded portions of said bolts engaging said internally threaded portions of said punch and die shoes and said heads received in said counter bored portions of said punch and die retainers, (g) said bolts having tool engageable sockets in said heads and leading ends thereof, (h) a plurality of press fitted dowels extending through said punch retainer and backing plate and into said punch shoe and through said die retainer into said die shoe, (i) punch and die button receiving sockets in said punch and die retainers, respectively, (j) a punch and a die button, each having a detent in an outer surface thereof, received in said punch and die button sockets, respectively, in alignment with each other, (k) passages extending from outer surfaces of said retainers into their respective sockets and slidably receiving plungers therein with heads of said plungers. projecting into said sockets and received in said detents, (l) set screws threadably received in said passages, engaging shank portions of said plungers and locking said heads thereof in said detents, (m) coil springs encircling said shank portions of said plungers and bearing at one end against said set screws and at an opposite end against collar portions of said plungers, (n) a stripper plate interposed between said punch and die retainers and having a plurality of internally threaded bolt holes therethrough and an opening therethrough aligned with said punch, (o) said punch shoe having stripper bolt holes therethrough having counter bored portions in a surface of said punch shoe opposite said surface adjacent said punch retainer, (p) stripper bolts each having a head, a first, relatively large diameter, unthreaded shank portion adjacent said head, a leading end, a second, relatively small diameter, threaded shank portion adjacent said leading end and a tool engageable socket in said head and leading end, (q) said stripper bolts being slidably received in said stripper bolt holes through said punch shoe with said stripper bolt heads received in said counter bored portions of said punch shoe stripper bolt holes and said threaded shank portions engaged in said stripper plate threaded bolt holes, and (r) coil springs encircling said unthreaded shank portions of said stripper bolts, bearing against said punch shoe and said stripper plate and urging said stripper plate away from said punch shoe.

* * * * *